US008806787B2

(12) United States Patent
Engelby et al.

(10) Patent No.: US 8,806,787 B2
(45) Date of Patent: Aug. 19, 2014

(54) COLLATION OF MARKETING SIGNS

(75) Inventors: Daniel G. Engelby, Andover, MN (US); Christopher H. Kaye, Buffalo, MN (US)

(73) Assignee: Target Brands, Inc., Minneapolis, MN (US)

( * ) Notice: Subject to any disclaimer, the term of this patent is extended or adjusted under 35 U.S.C. 154(b) by 1126 days.

(21) Appl. No.: 12/784,085

(22) Filed: May 20, 2010

(65) Prior Publication Data

US 2011/0283578 A1 Nov. 24, 2011

(51) Int. Cl.

| | |
|---|---|
| ***G09F 7/00*** | (2006.01) |
| ***G09F 15/00*** | (2006.01) |
| ***G09F 3/20*** | (2006.01) |
| ***G09F 3/00*** | (2006.01) |
| *G09F 3/02* | (2006.01) |

(52) U.S. Cl.

CPC ..... *G09F 3/0288* (2013.01); *G09F 3/204* (2013.01); *G09F 2003/0264* (2013.01); *G09F 3/0297* (2013.01)

USPC ..... 40/299.01; 101/24

(58) Field of Classification Search

USPC ..... 40/299.01; 101/24; 358/474

See application file for complete search history.

(56) References Cited

U.S. PATENT DOCUMENTS

| | | | | |
|---|---|---|---|---|
| 2,627,682 | A | 2/1953 | Markey | |
| 3,628,266 | A | 12/1971 | Wise et al. | |
| 3,937,493 | A | 2/1976 | Fasbender | |
| 5,111,943 | A | 5/1992 | Ramey | |
| 5,271,643 | A | 12/1993 | Hafele | |
| 5,297,685 | A | 3/1994 | Ramey | |
| 5,395,137 | A | 3/1995 | Kim | |
| 5,503,435 | A | 4/1996 | Kline | |
| 5,955,166 | A | 9/1999 | Murphy | |
| 6,217,074 | B1 | 4/2001 | Conley, Jr. | |
| 6,736,428 | B1 | 5/2004 | Insalaco | |
| 7,580,164 | B2 * | 8/2009 | Barrus et al. | 358/474 |
| 2004/0135364 | A1 | 7/2004 | Dale et al. | |
| 2006/0191426 | A1 * | 8/2006 | Timmerman et al. | 101/24 |
| 2009/0234668 | A1 | 9/2009 | Wheeler | |

* cited by examiner

*Primary Examiner* — Casandra Davis

(74) *Attorney, Agent, or Firm* — Leanne Taveggia Farrell; Westman, Champlin & Koehler, P.A.

(57) ABSTRACT

A collation of printed marketing signs for delivery or distribution to a retail store includes at least a first group of marketing signs and a second group of marketing signs. Each group has at least one stack of marketing signs for altering product display structures in a retail store and each marketing sign in each stack has a same non-rectangular shape. The first group of signs includes a first level of priority and the second group of signs includes a second level of priority. The first level of priority indicates that the first group of signs be set in the store before the second group of signs, which have the second level of priority.

14 Claims, 12 Drawing Sheets

COLLATION OF MARKETING SIGNS

BACKGROUND

Retail stores use various types of product display structures to present products to customers for purchase. These display structures both support the product for display and indicate the product price. Example display structures include shelf and peg hook structures.

Often, retailers desire to highlight certain products that are being displayed for sale. For example, a retailer may want to bring certain products to the attention of the customer because they were advertised in a certain media format, such as a catalog, a circular or a commercial. In another example, a retailer may want to draw attention to certain products that have certain characteristics not possessed by similarly displayed products, such as products that are on sale or products that offer promotional incentives with their purchase. In yet another example, a retailer may want to temporarily change the prices of certain products to reflect a sale price.

Often, retailers spotlight these products by adding an additional visual element that extends beyond the normal price label or covers the regular price label so as to draw attention to the product. For example, marketing signs can be added to product display structures near the price label of the products to be highlighted.

The discussion above is merely provided for general background information and is not intended to be used as an aid in determining the scope of the claimed subject matter.

SUMMARY

A collation of printed marketing signs for delivery or distribution to a retail store includes at least a first group of printed sheet material and a second group of printed sheet material. Each group includes at least one stack having a plurality of marketing signs for altering product display structures in a retail store. Each marketing sign in each stack has the same non-rectangular shape. The collation also includes a stack header sheet placed on top of each stack and having the same non-rectangular shape as the marketing signs in the stack. Each stack header sheet indicates a priority level of the group the stack belongs with and a numerical identifier indicating the sequential order of the stack in the group. At least one separator sheet is located within the group and has the same non-rectangular shape as the marketing signs in the stack the separator sheet occupies. The separator sheet includes instructions indicating how to determine a location the marketing signs positioned below the separator sheet should be set in the store. The first group of sheets has a first level of priority and the second group of sheets has a second level of priority. The first level of priority indicates that the first group of sheets should be set in the store before the second group of sheets.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein comprise a collation of printed marketing signs for delivery or distribution to a retail store. The collated marketing signs are shipped or delivered to a particular retail store where they are used to alter product display structures. The collation utilizes other types of printed sheet material than just marketing signs, such as stack header sheets placed on top of each stack of marketing signs and indicative of the priority level for setting the marketing signs positioned below each stack header sheet in the store. Another type of printed sheet material included in the collation are separator sheets placed between marketing signs in the stacks that indicate where the marketing signs located below each separator sheet should be set in the retail store. Each of the stack header sheets and the separator sheets has the same non-rectangular shape as the non-rectangular shape of the marketing signs.

Figure 1:
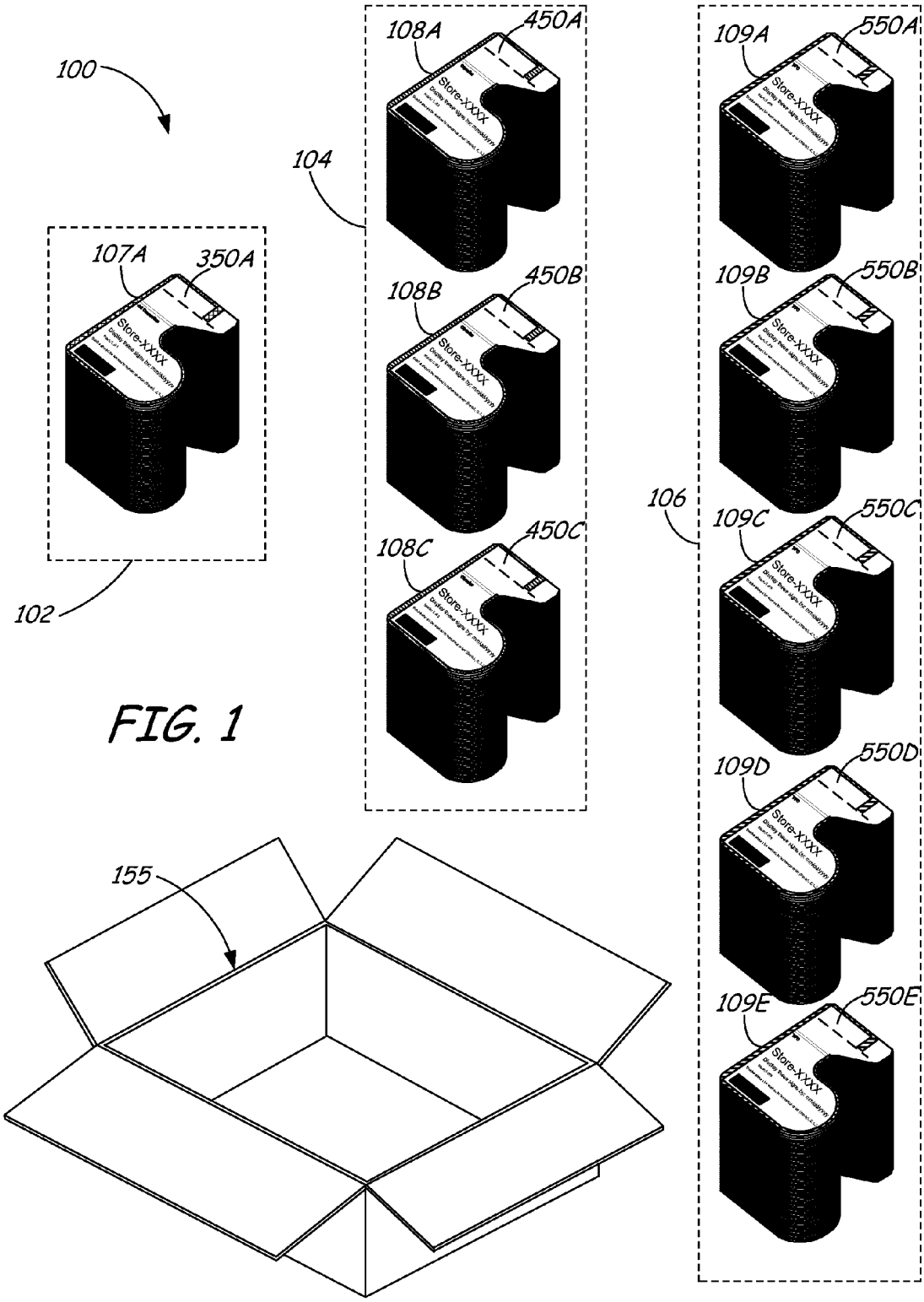
FIG. 1 illustrates a diagrammatical view of a collation of marketing signs for a retail store under one embodiment.

FIG. 1 illustrates a perspective view of a collation 100 of marketing signs for a retail store under one embodiment. Collation 100 includes at least a first group 102 of marketing signs, a second group 104 of marketing signs and a third group 106 of marketing signs. Each group 102, 104 and 106 has at least one stack and includes a plurality of marketing signs for altering product display structures in a retail store, where each marketing sign in each stack has the same non-rectangular shape. Before collation 100 is formed, first group 102, second group 104 and third group 106 of marketing signs are printed and cut into their non-rectangular shape.

In FIG. 1, the first group 102 includes a single stack 107A, the second group 104 includes three stacks (first 108A, second 108B and third 108C stacks) and the third group 106 includes five stacks (first 109A, second 109B, third 109C, fourth 109D and fifth 109E stacks). It should be realized, however, that each group 102, 104 and 106 can have any number of stacks depending on how many printed marketing signs belong to the group. The marketing signs in each stack of collation 100 are held together with transparent shrink wrap and then placed in a box 155 for shipping to a retail store.

Figure 2:
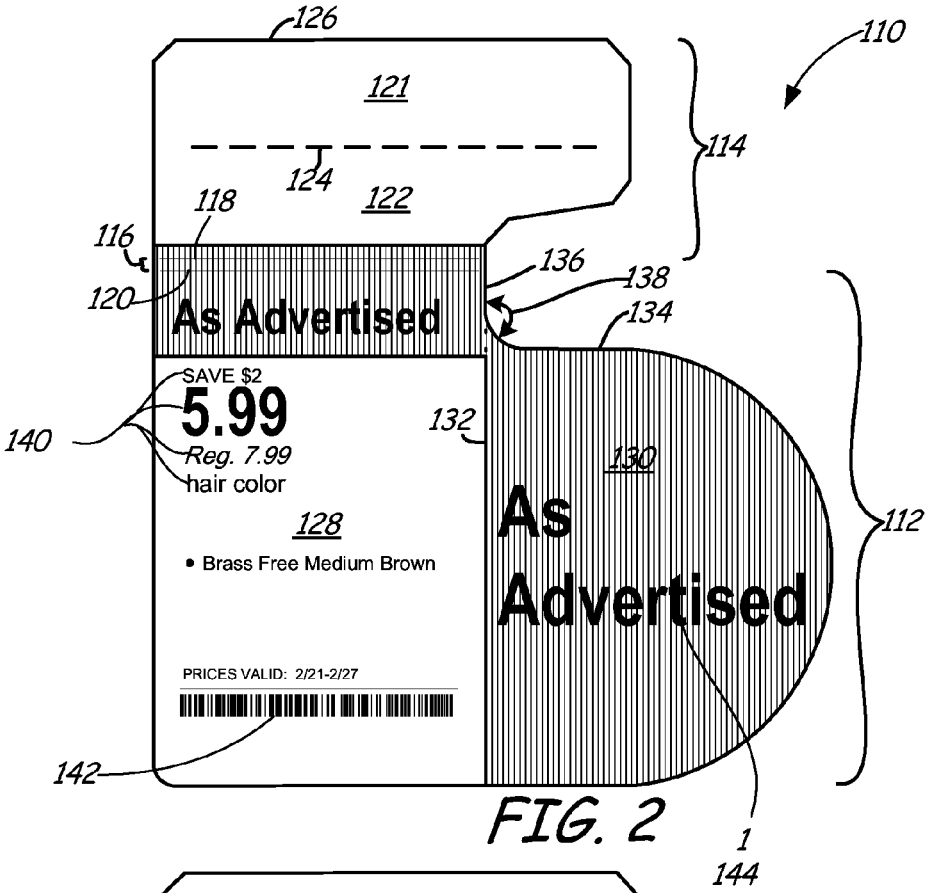
FIG. 2 illustrates a front view of an exemplary marketing sign.

FIG. 2 illustrates a front view of an exemplary marketing sign 110. Exemplary marketing sign 110 is for use in altering a product display structure and is formed with a pliable yet resilient sheet material into a non-rectangular shape. For example, the sheet material can include polystyrene; however, other resilient sheet materials may be used. As discussed above, the non-rectangular marketing sign 110 can be manufactured with a variety of different types of punch and die machines and/or laser cutting machines and a printing device before marketing sign 110 is collated with other marketing signs.

Marketing sign 110 includes a free portion 112, a base portion 114 and a connecting portion 116, which couples the free portion 112 to the base portion 114. Connecting portion 116 is defined between a first connecting bend line 118 spaced apart from a second connecting bend line 120. Base portion 114 includes an engaging piece 121 for engaging with a product display structure coupled to a support piece 122 at a base bend line 124. Base bend line 124 is oriented substantially parallel with the first and second connecting bend lines 118 and 120. Engaging piece 121 is defined between a base edge 126 and base bend line 124. Support piece 122 is defined between first connecting bend line 118 and base bend line 124. Connecting portion 116 couples support piece 122 of base portion 114 to free portion 112 such that first connecting bend line 118 is adjacent support piece 122 and second connecting bend line 120 is adjacent free portion 112. First and second connecting bend lines 118 and 120 and base bend line 124 can be any type of suitable marking, such as slits, scores or perforations that would aid in easily bending the sheet material along the marking.

Free portion 112 includes a price piece 128 coupled to a balloon piece 130 at a free bend line 132. Free bend line 132 is oriented substantially normal to the first and second connecting bend lines 118 and 120 and like bend lines 118, 120 and 124, free bend line 132 can be any type of suitable marking, such a slits, scores or perforations, that would aid in easily bending the sheet material along the marking to place balloon piece 130 out of plane from price piece 128. Balloon piece 130 includes a top edge 134 spaced apart and below second connecting bend line 120. Price piece 128 includes a side edge 136 located between second connecting bend line 120 and top edge 134 of balloon piece 130. Side edge 136 is oriented substantially normal with respect to first and second connecting bend lines 118 and 120. Top edge 134 of balloon piece 130 intersects with side edge 136 of price piece 128 at an angle 138 that is greater than 90 degrees and less than 180 degrees.

Price piece 128 includes printed indicia 140 indicative of, for example, a new sale price, the cost savings of the new price, the regular or normal price and the type of product displayed for purchase. Price piece 128 also includes a bar code 142. Bar code 142 encodes a number that indexes a database entry in a database. The database entry includes information about the marketing sign, such as the information displayed as indicia 140 as well as a product identifier. Balloon piece 130 includes printed indicia 144 indicative of a type of marketing sign. Marketing signs highlight certain products that are being displayed for sale. For example, a retailer may want to bring products to the attention of the customer because they were advertised in a certain media format, such as a catalog, a circular or a commercial. In another example, a retailer may want to draw attention to products that have certain characteristics not possessed by similarly displayed products, such as products that are on sale or products that offer promotional incentives with their purchase. In yet another example, a retailer may want to temporarily change the prices of certain products to reflect a sale price. As illustrated in FIG. 2, balloon piece 130 in exemplary marketing sign 110 indicates that the product is being highlighted because a sale price was advertised in a media format, such as a circular.

Marketing sign 110 illustrated in FIG. 2 includes a price piece 128 having a width dimension of approximately 2 inches from a left side edge to free bend line 132 and having a height dimension of approximately 3 inches from a bottom edge to between first and second connecting bend lines 118 and 120. However, other relative dimensions are possible to make different sized marketing signs. For example, a width dimension of price piece 128 can be 5 inches and a height dimension of price piece 128 can be 3 inches.

Figure 3:
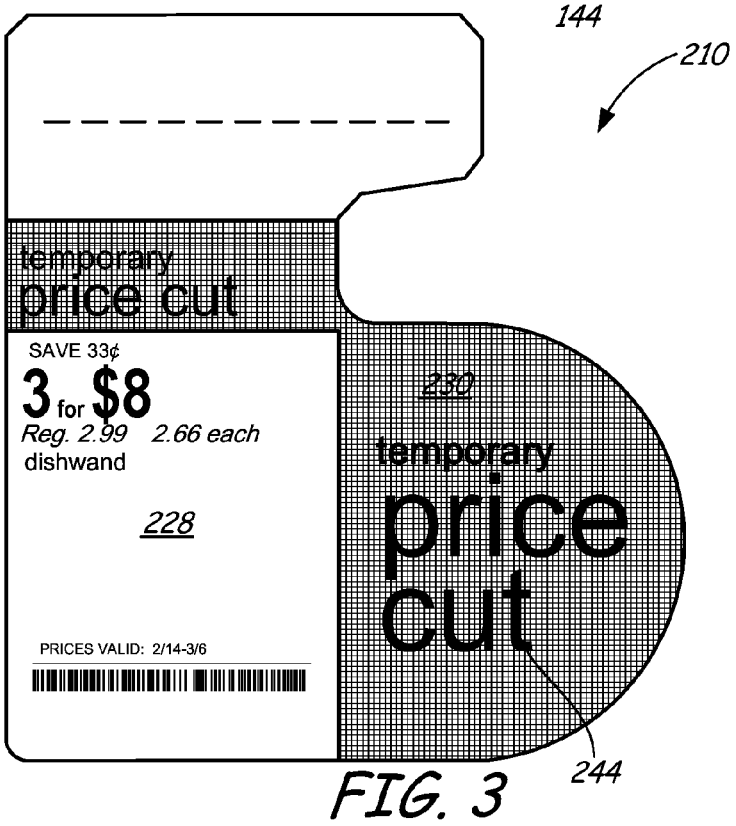
FIG. 3 illustrates a front view of another exemplary marketing sign.

FIG. 3 illustrates a front view of another exemplary marketing sign 210. Like sign 110, exemplary printed marketing sign 210 is for use with a product display structure and formed with a pliable yet resilient sheet material into a non-rectangular shape. The non-rectangular marketing sign 210 can be manufactured with a variety of different types of punch and die machines and/or laser machines and a printing device.

Marketing sign 210 includes all of the same features as marketing sign 110. However, balloon piece 230 includes printed indicia 244 indicative of a different type of marketing sign. Balloon piece 230 in exemplary marketing sign 210 indicates that the product is being highlighted because the sale price of the product has been temporarily changed to reflect a new sale price. In addition, although marketing sign 210 illustrated in FIG. 3 includes a price piece 228 having a width dimension of approximately 2 inches and having a height dimension of approximately 3 inches, other relative dimensions are possible to make different sized marketing signs. For example, a width dimension of price piece 228 can be 5 inches and a height dimension of price piece 228 can be 3 inches.

With reference back to FIG. 1, each stack in each group 102, 104 or 106 of collation 100 includes a stack header sheet or pile header sheet placed on top of each stack or pile 108 where the stack header sheet has the same non-rectangular shape as each marketing sign in the stack. In first group 102, stack 107A includes a stack header sheet 350A. In second group 104, first stack 108A includes a stack header sheet 450A, second stack 108B includes a stack header sheet 450B and third stack 108C includes a stack header sheet 450C. In third group 106, first stack 109A includes a stack header sheet 550A, second stack 109B includes a stack header sheet 550B, third stack 109C includes a stack header sheet 550C, fourth stack 109D includes a stack header sheet 550D and fifth stack 109E includes a stack header sheet 550E.

Figure 4:
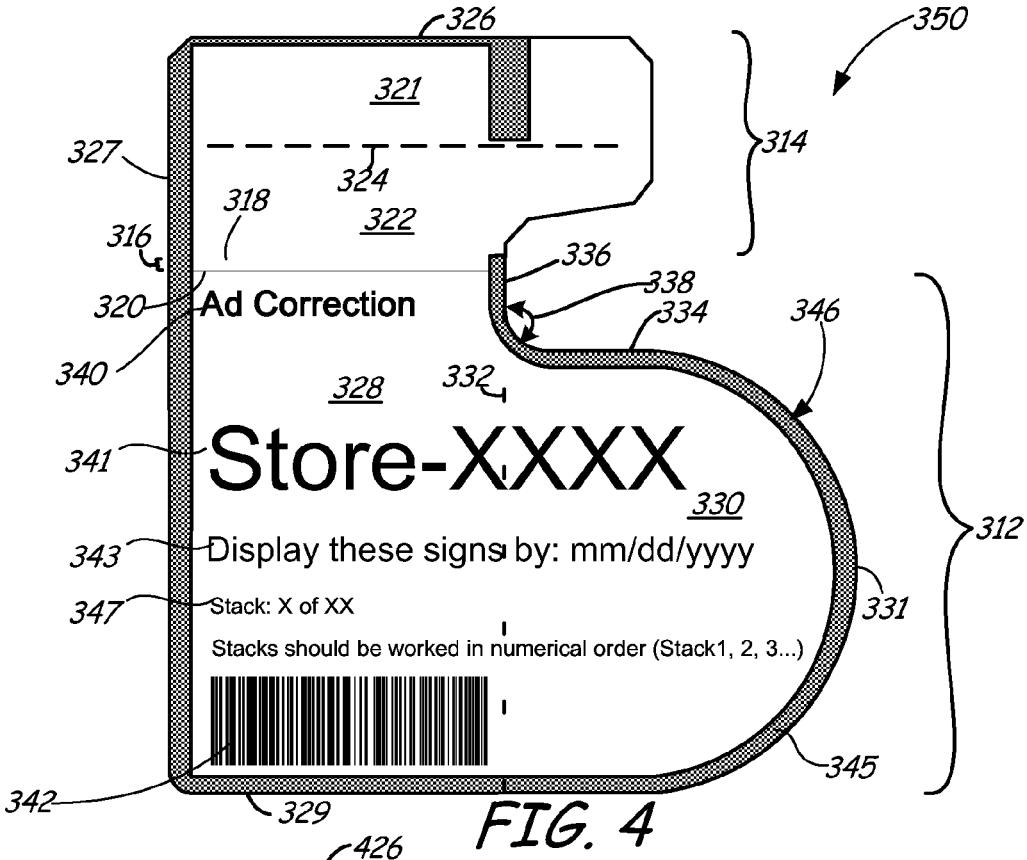
FIG. 4 illustrates a front view of an exemplary stack header sheet for placing on top of a stack in a first group of marketing signs under one embodiment.

FIG. 4 illustrates a detailed front view of an exemplary stack header sheet or pile header sheet 350 under one embodiment for placing on top of each stack or pile in the first group 102 (FIG. 1) of marketing signs. Stack header sheet 350 is formed with the same pliable yet resilient sheet material and formed into the same non-rectangular shape as the marketing signs below the stack header sheet 350.

Like marketing signs 110 and 210, stack header sheet 350 includes components that match marketing signs 110 and 210. For example, stack header sheet 350 includes a free portion 312, a base portion 314 and a connecting portion 316, which couples the free portion 312 to the base portion 314. Connecting portion 316 is defined between a first connecting bend line 318 spaced apart from a second connecting bend line 320. Base portion 314 includes an engaging piece 321 coupled to a support piece 322 at a base bend line 324. Base bend line 324 is oriented substantially parallel with the first and second connecting bend lines 318 and 320. Engaging piece 321 is defined between a base edge 326 and base bend line 324. Support piece 322 is defined between first connecting bend line 318 and base bend line 324. In other words, connecting portion 316 couples support piece 322 of base portion 314 to free portion 312 such that first connecting bend line 318 is adjacent support piece 322 and second connecting bend line 320 is adjacent free portion 312. First and second connecting bend lines 318 and 320 and base bend line 324 match marketing signs 110 and 210 and can be any type of suitable marking, such as slits, scores or perforations.

Free portion 312 includes a price piece 328 coupled to a balloon piece 330 at a free bend line 332. Free bend line 332 is oriented substantially normal to the first and second connecting bend lines 318 and 320 and like bend lines 318, 320 and 1324, free bend line 332 can be any type of suitable marking, such a slits, scores or perforations. Balloon piece 330 includes a top edge 334 spaced apart and below second connecting bend line 320. Price piece 328 includes a side edge 336 located between second connecting bend line 320 and top edge 334 of balloon piece 330. Side edge 336 is oriented substantially normal with respect to first and second connecting bend lines 318 and 320. Top edge 334 of balloon piece 330 intersects with side edge 336 of price piece 328 at an angle 338 that is greater than 90 degrees and less than 180 degrees.

Stack header sheet 350 includes a set of printed indicia. Printed indicia 340 includes indicia related to the type of marketing signs that are in the first group 102 for which the stack header sheet 350 belongs. For example, all signs in the group of which stack header sheet 350 belongs are ad correction signs. Therefore, marketing signs below stack header sheet 350 are for correcting existing signs that have errors. Printed indicia 341 includes a numerical store identifier indicative of the particular retail store to which collation 100 of marketing signs belongs, printed indicia 343 includes a date marketing signs in the stack 108 need to be set by for display and printed indicia 347 includes a numerical stack identifier identifying the numerical stack for which the stack header sheet 350 belongs. For example, in FIG. 1, first group 102 includes only a single stack 107A. Therefore, printed indicia 347 would indicate Stack: 1 of 1 for stack header sheet 350A.

In addition, stack header sheet 350 includes a bar code 342. Bar code 342 encodes a numeric value that can be used to index a database entry in a database. The database entry includes at least the numerical store identifier also printed as indicia 341 on the stack header sheet 350. The database entry for bar code 342 can include additional information pertaining to marketing signs in the first group 102. For example, the entry can indicate the type of marketing signs, a date the marketing signs in the stack need to be set by for display, a numerical stack identifier identifying the stack the stack header sheet 350 is lying on and etc.

With reference back to FIG. 1, each group 102, 104 and 106 includes a priority level. For example, first group 102 can include a first level of priority, second group 104 can include a second level of priority and third group 106 can include a third level of priority. The first level of priority indicates that the first group 102 of printed marketing signs should be set in a retail store before the second group 104 having the second level of priority and the third group 106 having the third level of priority. Similarly, the second level of priority indicates that the second group 104 of printed marketing signs should be set in a retail store after the first group 102 having the first level of priority and before the third group 106 having the third level of priority. The third level of priority indicates that the third group 106 of printed marketing signs should be set in a retail store after the first group 102 having the first level of priority and after the second group having the second level of priority.

In FIG. 4, stack header sheet 350 is indicative of a priority level of the group for which it belongs. In this case, exemplary stack header sheet 350 is indicative of a first level of priority for the first group 102 of marketing signs. The first priority level is indicated by a border 345 having a first color 346 that runs along a portion of base edge 326, the left side edge 327, the bottom edge 329, the circumferential balloon edge 331, the top edge 334 of the balloon piece 330 and along a portion of side edge 336. For example, first color 346 can be orange as indicated by the hatched lines of border 345. The orange color indicates that the first group 102 of marketing signs has the highest priority for setting in the retail store. Under one embodiment, marketing signs given the highest priority are signs that correct other signs already set in the store and contain errors.

Figure 5:
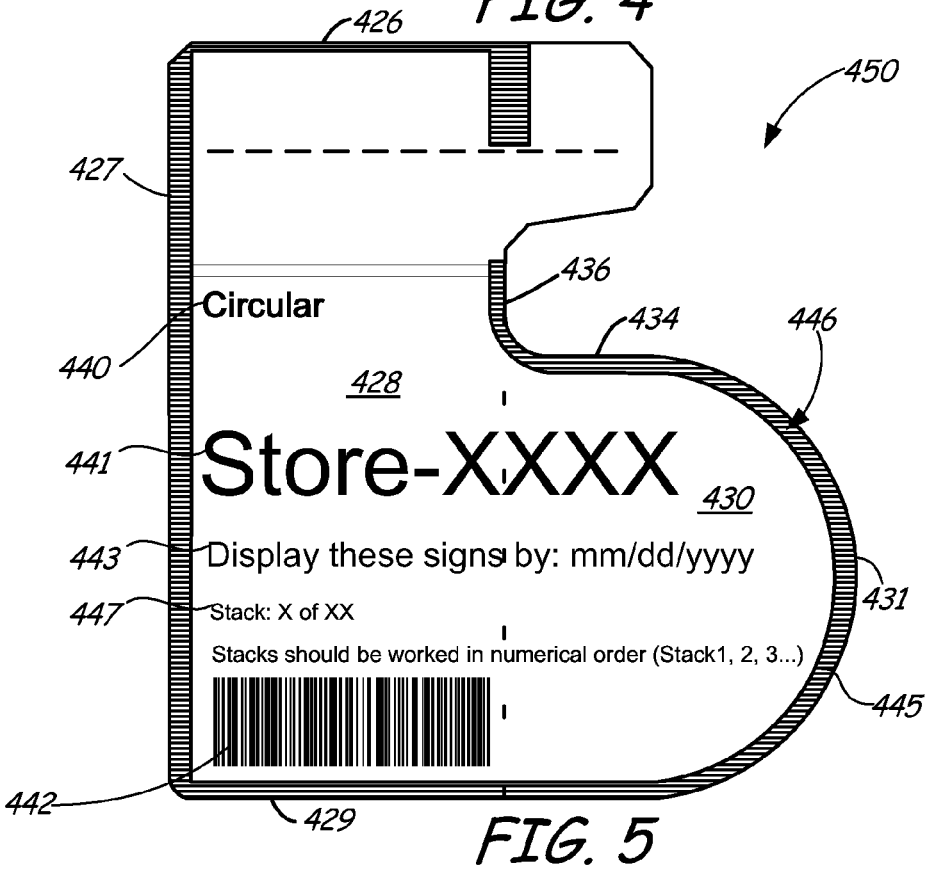
FIG. 5 illustrates a front view of an exemplary stack header sheet for placing on top of a stack in a second group of marketing signs under one embodiment.

FIG. 5 illustrates a detailed front view of an exemplary stack header sheet or pile header sheet 450 under one embodiment for placing on top of each stack or pile in the second group 104 (FIG. 1) of marketing signs. Stack header sheet 450 is formed with the same pliable yet resilient sheet material and formed into the same non-rectangular shape as marketing signs below the stack header sheet 450.

Stack header sheet 450 includes all of the same features as exemplary stack header sheet 350. However, the set of printed indicia printed on stack header sheet 450 are somewhat different. Printed indicia 440 includes indicia related to the type of marketing signs that are in the second group 104 (FIG. 1) for which the stack header sheet 450 belongs. For example, all signs in the group of which stack header sheet 450 belongs are circular signs. Therefore, marketing signs below stack header sheet 450 reflect new sale prices for product advertised in a circular (such as a weekly circular). Printed indicia 441 includes a numerical store identifier indicative of the particular retail store in which the collation 100 of marketing signs belongs, printed indicia 443 includes a date the marketing signs in the stack need to be set by for display and printed indicia 447 includes a numerical stack identifier identifying the numerical stack for which the stack header sheet 450 belongs. For example, in FIG. 1, second group 104 includes three stacks 108A, 108B and 108C. Therefore, printed indicia 347 would indicate Stack: 1 of 3 on stack header sheet 450A lying on top of the first stack, Stack: 2 of 3 on stack header sheet 450B lying on top of the second stack and Stack: 3 of 3 on stack header sheet 450C lying on top of the third stack depending on which stack it belongs.

In addition, stack header sheet 450 includes a bar code 442. Bar code 442 encodes a numeric value that indexes a database entry that contains at least the numerical store identifier also printed as indicia 441 on the stack header sheet 450. The database entry for bar code 442 can include other information pertaining to marketing signs in the second group 104. For example, the entry can indicate the type of marketing signs, a date the marketing signs in the stack need to be set by for display, a numerical stack identifier identifying the stack the stack header sheet 450 is lying on and etc.

Stack header sheet 450 is also indicative of a priority level of the group to which it belongs. In this case, exemplary stack header sheet 450 is indicative of a second level of priority for the second group 104 of marketing signs. The second priority level is indicated by a border 445 having a second color 446 that runs along a portion of base edge 426, the left side edge 427, the bottom edge 429, the circumferential balloon edge 431, the top edge 434 of the balloon piece 430 and along a portion of side edge 436. For example, second color 446 can be cyan or blue as indicated by the horizontal lines of border 445. The blue color indicates that the second group 104 of marketing signs has the second priority for setting in the retail store. Under one embodiment, signs with the second level of priority are signs that reflect new sale prices for products advertised in a circular.

Figure 6:
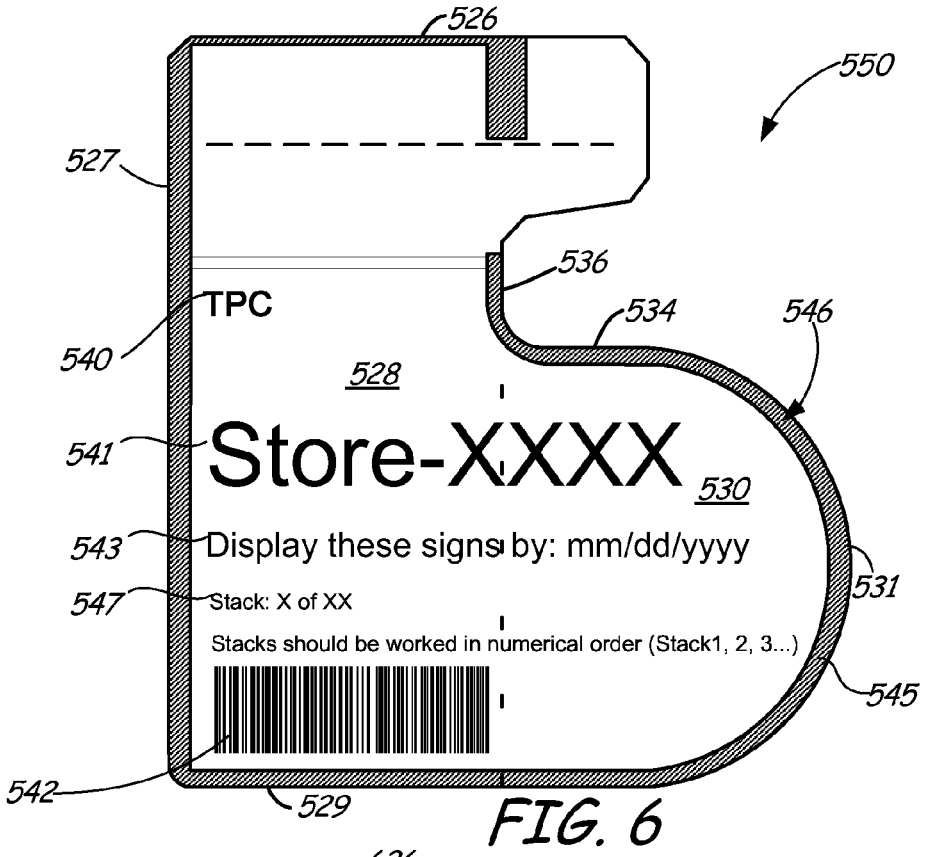
FIG. 6 illustrates a front view of an exemplary stack header sheet for placing on top of a stack in a third group of marketing signs under one embodiment.

FIG. 6 illustrates a detailed front view of an exemplary stack header sheet or pile header sheet 550 under one embodiment for placing on top of each stack or pile in the third group 106 (FIG. 1) of marketing signs. Stack header sheet 550 is formed with the same pliable yet resilient sheet material and formed into the same non-rectangular shape as marketing signs below the stack header sheet 550.

Stack header sheet 550 includes all of the same features as exemplary stack header sheets 350 and 450. However, the set of printed indicia printed on stack header sheet 550 are somewhat different. Printed indicia 540 includes indicia related to the type of marketing signs that are in the third group 106 (FIG. 1) for which the stack header sheet 550 belongs. For example, all signs in the group of which stack header sheet 550 belongs are temporary price cut (TPC) signs. Therefore, marketing signs below stack header sheet 550 reflect new sale prices for products that have been temporarily reduced in price. Printed indicia 541 includes a numerical store identifier indicative of the particular retail store to which collation 100 of marketing signs belongs, printed indicia 543 includes a date the marketing signs in the stack need to be set by for display and printed indicia 547 includes a numerical stack identifier identifying the numerical stack to which the stack header sheet 550 belongs. For example, in FIG. 1, third group 106 includes five stacks 109A, 109B, 109C, 109D and 109E. Therefore, printed indicia 447 would indicate Stack: 1 of 5 on the stack header sheet 550A lying on top of the first stack 109A, Stack: 2 of 5 on the stack header sheet 550B lying on top of the second stack 109B, Stack: 3 of 5 on the stack header sheet 550C lying on top of the third stack 109C, Stack: 4 of 5 on the stack header sheet 550D lying on top of the fourth stack 109D and Stack: 5 of 5 on the stack header sheet 550E lying on top of the fifth stack 109E.

In addition, stack header sheet 550 includes a bar code 542. Bar code 542 encodes a numeric value that indexes a database entry that contains at least the numerical store identifier also printed as indicia 541 on the stack header sheet 550. The database entry for bar code 542 can include other information pertaining to marketing signs on the third group 106. For example, the type of marketing signs, a date the marketing signs in the stack 108 need to be set by for display, a numerical stack identifier identifying the stack 108 the stack header sheet 550 is lying on and etc.

Stack header sheet 550 is also indicative of a priority level of the group to which it belongs. In this case, exemplary stack header sheet 550 is indicative of a third level of priority in the third group 106 of marketing signs. The third priority level is indicated by a border 545 having a third color 546 that runs along a portion of base edge 526, the left side edge 527, the bottom edge 529, the circumferential balloon edge 531, the top edge 534 of the balloon piece 530 and along a portion of side edge 536. For example, third color 546 can be magenta or pink as indicated by the diagonal lines of border 545. The pink color indicates that the third group 106 of marketing signs has third priority for setting in the retail store. Under one embodiment, signs with the third highest priority are signs that reflect new sale prices for products being temporarily reduced in price.

Although FIGS. 1 and 4-6 illustrate three groups of stacks of marketing signs and three different types of stack header sheets for the three different groups of stacks, it should be realized that collation 100 can include more than three groups of stacks and there can be more than three different types of stack header sheets.

With reference back to FIG. 1, each group 102, 104 or 106 of collation 100 includes at least one separator sheet or block header sheet located within each group and having the same non-rectangular shape as the marketing signs and the stack header sheet of the stack to which the separator sheet belongs. Different types of separator sheets divide a group of the collation 100 into different sections based on where marketing signs located below a select separator sheet should be set in the store. More particularly, instructions are printed on each separator sheet describing or indicating where or how to determine where to set the marketing signs below the separator sheet.

Figure 7:
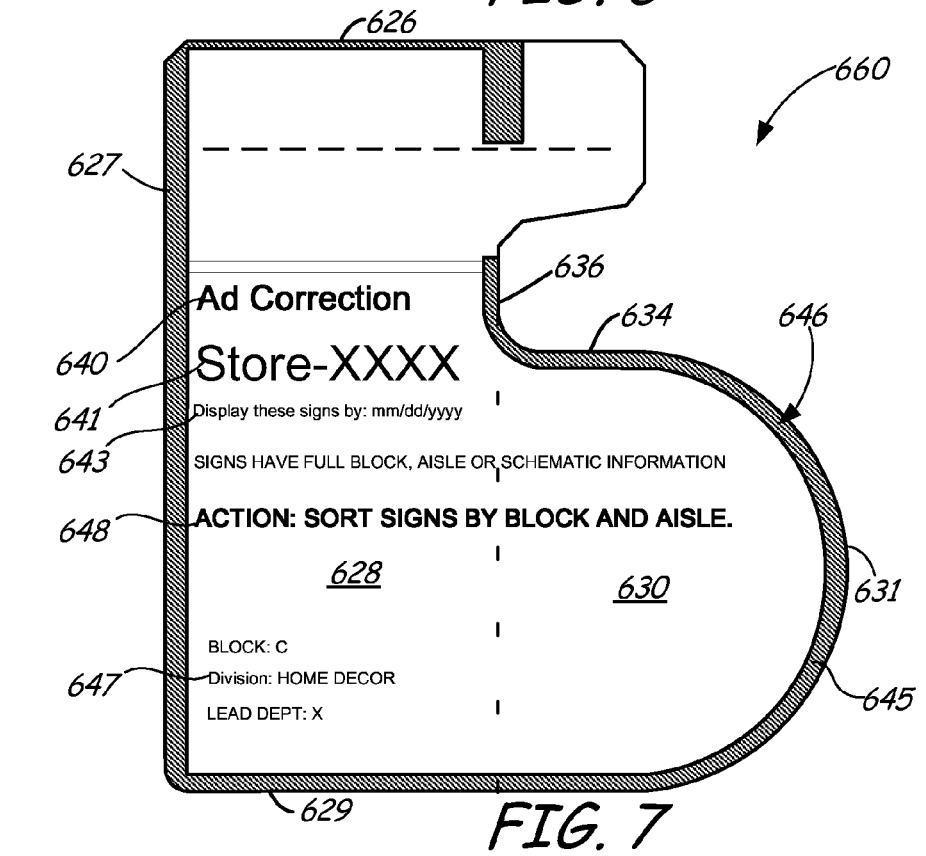
FIG. 7 illustrates a front view of an exemplary first separator sheet for placing within the first group of marketing signs under one embodiment.

FIG. 7 illustrates a front view of an exemplary first type of separator sheet or first type of block header sheet 660 for placing within the first group 102 (FIG. 1) of marketing signs under one embodiment. First type of separator sheet 660 is formed with the same pliable yet resilient sheet material and formed into the same non-rectangular shape as marketing signs above and below the separator sheet 660.

First type of separator sheet 660 includes similar features as stack header sheets 350, 450 and 550. However, the set of printed indicia printed on first type of separator sheet 660 is different. Printed indicia 640 includes indicia related to the type of marketing signs that are in the first group 102 (FIG. 1) of marketing signs to which the separator sheet 660 belongs. For example, all signs in the group to which exemplary first type of separator sheet 660 belongs are ad correction signs. Therefore, marketing signs above and below first type of separator sheet 660 are for correcting existing signs that have errors. Printed indicia 641 includes a numerical store identifier indicative of the particular retail store to which the collation 100 of marketing signs belongs, printed indicia 643 includes a date the marketing signs in the first group 102 need to be set by for display, and printed indicia 648 includes an action or instructions indicating what area of the store (identified in printed indicia 641 as a store number and to which the marketing signs belong) the marketing signs below first type of separator sheet 660 should be set. For first type of separator sheet 660, printed indicia 648 instructs that marketing signs below the first type of separator sheet 660 are ordered in accordance with a specific area of a planogram layout (i.e., the ordered block and aisle) of the store identified in printed indicia 641. In addition, first type of separator sheet 660 includes printed indicia 647. Printed indicia 647 describe where in the planogram layout the marketing signs below the first type of separator sheet 660 belong. For example, a team member can take marketing signs located below exemplary first type of separator sheet 660 and go to block C of the Home Décor area. Each sign below first separator sheet 660 is ordered in block C of Home Décor in descending aisle/block number order.

First type of separator sheet 660 also includes a border 645 having a first color 646. The color 646 indicates how to set the signs below first type of separator sheet 660. Border 645 runs along a portion of base edge 626, the left side edge 627, the bottom edge 629, the circumferential balloon edge 631, the top edge 634 of the balloon piece 630 and along a portion of side edge 636. For example, first color 646 can be green as indicated by the diagonal lines of border 645. Under one embodiment, the green color indicates that marketing signs below first type of separator sheet 660 can be set in the store in planogram order as set out by printed indicia 647.

Figure 8:
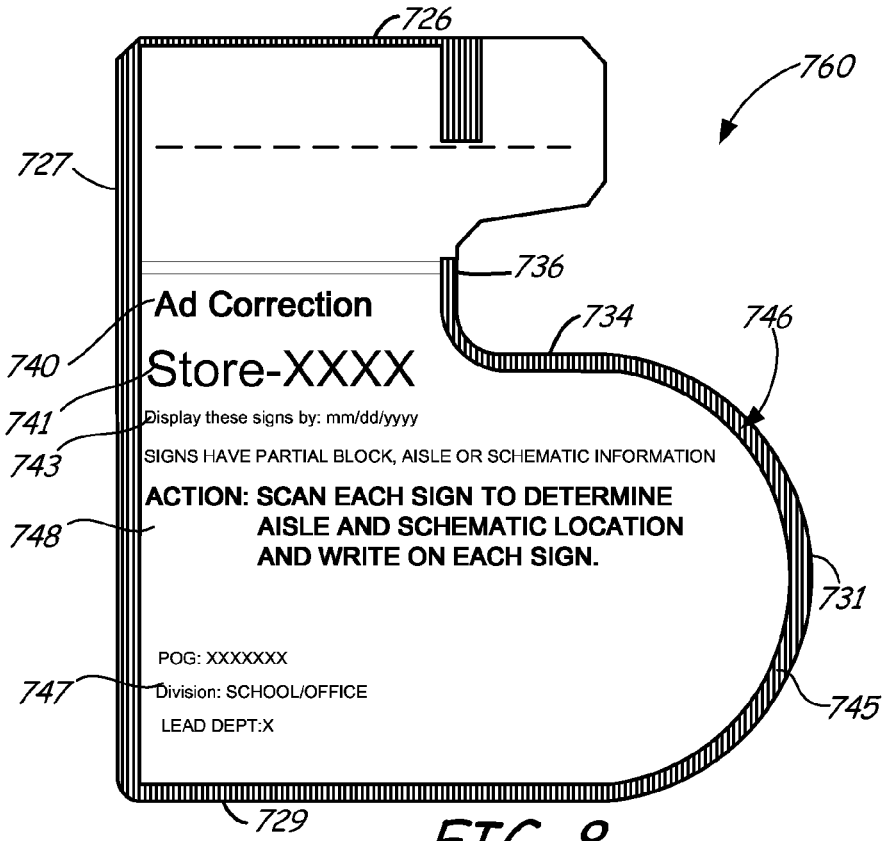
FIG. 8 illustrates a front view of an exemplary second separator sheet for placing within the first group of marketing signs under one embodiment.

FIG. 8 illustrates a front view of an exemplary second type of separator sheet or second type of block header sheet 760 for placing within the first group 102 (FIG. 1) of marketing signs under one embodiment. Second type of separator sheet 760 is formed with the same pliable yet resilient sheet material and formed into the same non-rectangular shape as marketing signs above and below the separator sheet 760.

Second type of separator sheet 760 includes all of the same features as first type of separator sheet 660 including printed indicia 740 related to the type of marketing signs in the first group 102 of sheet material (i.e., ad correction), printed indicia 741 including a numerical store identifier indicative of the particular retail store to which the collation 100 of marketing signs belongs, printed indicia 743 including a date the marketing signs in the first group 102 need to be set by for display, indicia 748 indicating an action to take to set the marketing signs located in the group below second type of separator sheet 760 and printed indicia 747 including the last known area in the planogram layout where the marketing signs below the second type of separator sheet 760 belong. Printed indicia 748 include an action or instructions different than that of first type of separator sheet 660. Specifically, printed indicia 748 instructs that the bar code in each marketing sign below the second separator sheet 760 needs to be scanned to determine where the current location of the product the marketing sign advertises is in the store because printed indicia 747 may not indicate the correct information. For example, although second separator sheet 760 gives a planogram identifier and the School/Office area in the store, the location of products for each marketing signs below second separator sheet 760 may have changed.

Second separator sheet 760 also includes a border 745 having a second color 746. The color 746 indicates how to set the signs located in the group below second type of separator sheet 760. Border 745 runs along a portion of base edge 726, the left side edge 727, the bottom edge 729, the circumferential balloon edge 731, the top edge 734 of the balloon piece 730 and along a portion of side edge 736. For example, second color 746 can be red as indicated by the vertical lines of border 745. Under one embodiment, the red color indicates that the bar codes on the marketing signs below second separator sheet 760 need to be scanned to determine where each marketing sign should be set in the store.

Although FIGS. 7 and 8 illustrate only exemplary first and second types of separator sheets 660 and 760 for use in the first group 102 of sheet material for collation 100, it should be realized that additional separator sheets can be used for instructing the setting of specific marketing signs in the first group in a certain way. For example, printed indicia can include instructions indicating that marketing signs should be set in a particular area of the store other than in planogram order and can accordingly include a different color border.

Figure 9:
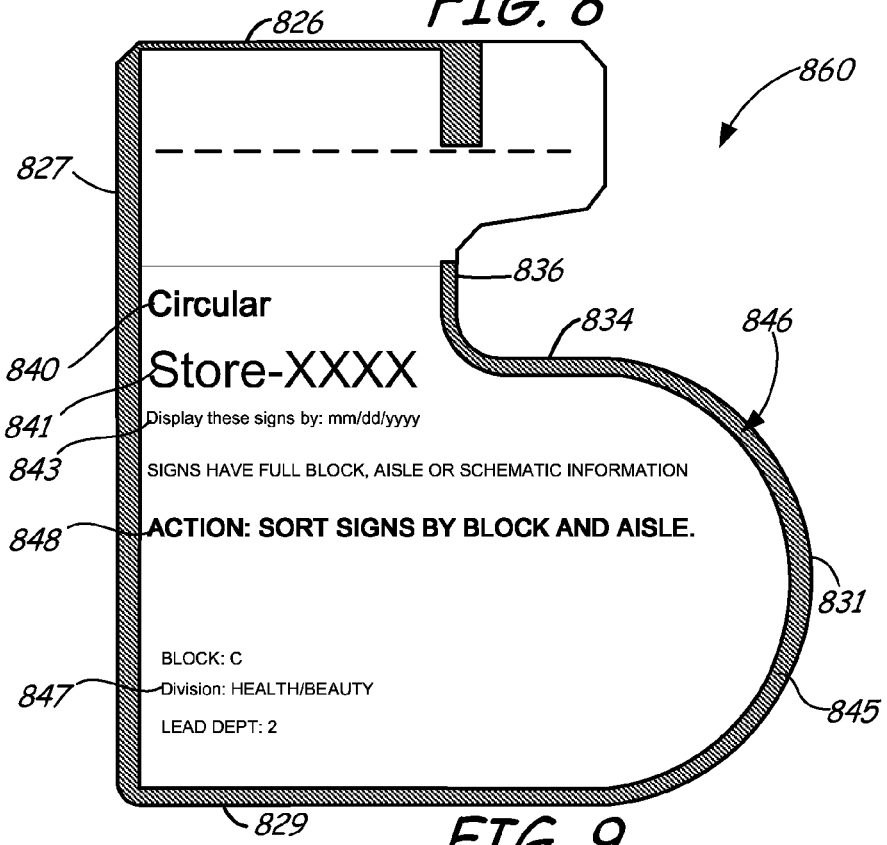
FIG. 9 illustrates a front view of an exemplary first separator sheet for placing within the second group of marketing signs under one embodiment.

FIG. 9 illustrates a front view of a first type of separator sheet or first type of block header sheet 860 for placing in the second group 104 (FIG. 1) of marketing signs under one embodiment. Like first type of separator sheet 660, first type of separator sheet 860 is formed with the same pliable yet resilient sheet material and formed into the same non-rectangular shape as marketing signs above and below the first separator sheet 860.

First type of separator sheet 860 includes all of the same features as first type of separator sheet 660 including printed indicia 840 related to the type of marketing signs that are in the second group 104 of marketing signs to which the first type of separator sheet 860 belongs. For example, all signs in the second group to which exemplary first type of separator sheet 860 belongs are circular signs. Therefore, marketing signs above and below first type of separator sheet 860 are to highlight products advertised in a circular. Printed indicia 841 includes a numerical store identifier indicative of the particular retail store the collation 100 (FIG. 1) of marketing signs belongs, printed indicia 843 includes a date the marketing signs in the second group 104 need to be set by for display, printed indicia 848 includes an action or instructions indicating what area of the store (identified in printed indicia 841 as a store number and to which the marketing signs belong) the marketing signs located below first type of separator sheet 860 should be set and printed indicia 847 describing the area in the planogram layout where the marketing signs below the first type of separator sheet 860 belongs. For example, a team member can take the marketing signs below exemplary first type of separator sheet 860 and go to the School/Office area. Each sign below first type of separator sheet 860 is ordered in accordance with the planogram (POG) information and in accordance with descending aisle/block number.

Like first type of separator sheet 660, first type of separator sheet 860 also includes a border 845 having a first color 846. The color 846 indicates how to set the signs below first type of separator sheet 860. Border 845 runs along a portion of base edge 826, the left side edge 827, the bottom edge 829, the circumferential balloon edge 831, the top edge 834 of the balloon piece 830 and along a portion of side edge 836. For example, first color 846 can be green as indicated by the diagonal lines of border 845. Under one embodiment, the green color indicates that marketing signs below first type of separator sheet 860 can be set in the store in planogram order.

Figure 10:
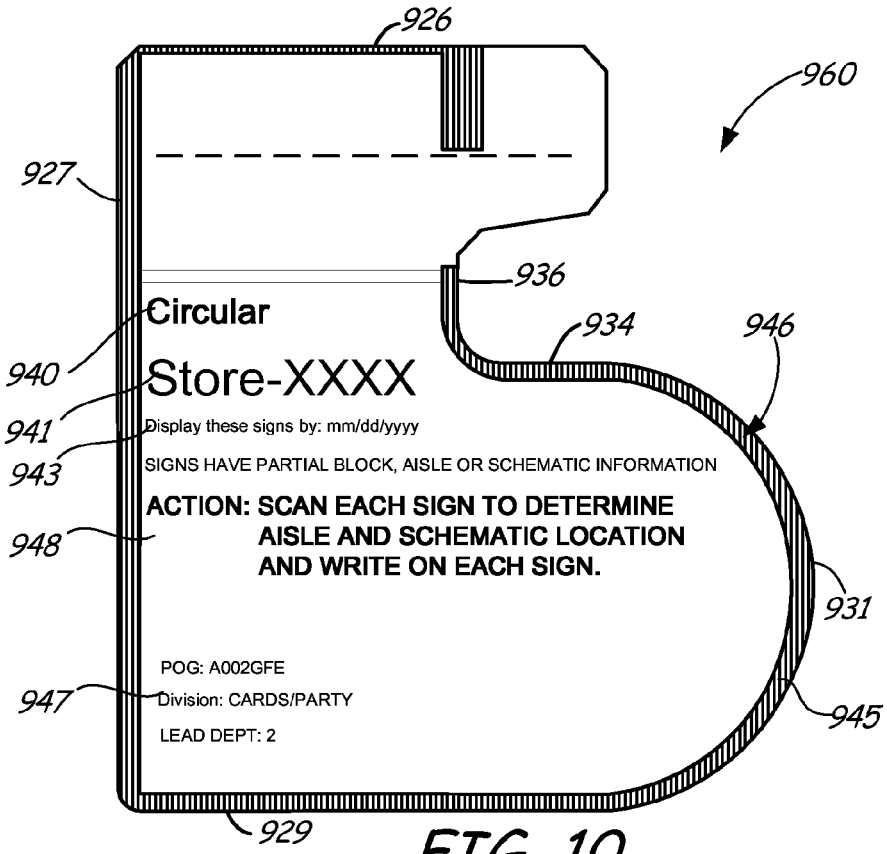
FIG. 10 illustrates a front view of an exemplary second separator sheet for placing within the second group of marketing signs under one embodiment.

FIG. 10 illustrates a front view of a second type of separator sheet or second type of block header sheet 960 for placing in the second group 104 (FIG. 1) of marketing signs under one embodiment. Second type of separator sheet 960 is formed with the same pliable yet resilient sheet material and formed into the same non-rectangular shape as marketing signs above and below the separator sheet 960.

Second type of separator sheet 960 includes all of the same features as first separator sheet 860 including printed indicia 940 related to the type of marketing signs in the second group 102 of marketing signs (i.e., circular), printed indicia 941 including a numerical store identifier indicative of the particular retail store to which the collation 100 of marketing signs belongs, printed indicia 943 including a date the marketing signs in the second group 104 need to be set by for display, printed indicia 948 indicating an action to take to set the marketing signs located in the group below separator sheet 960 and printed indicia 947 including the last known area in the planogram layout where the marketing signs below the second separator sheet 960 belong. Printed indicia 948 includes an action or instructions different than that of first type of separator sheet 860 and similar to the action or instructions included in second type of separator sheet 760 of first group 102. Specifically, printed indicia 948 instructs that the bar code in each marketing sign below the second type of separator sheet 960 needs to be scanned to determine where the current location of the product the marketing sign advertises is in the store because printed indicia 947 may not indicate the correct information.

Like second type of separator sheet 760, second type of separator sheet 960 also includes a border 945 having a second color 946. The color 946 indicates how to set the signs located in the group below second type of separator sheet 960. Border 945 runs along a portion of base edge 926, the left side edge 927, the bottom edge 929, the circumferential balloon edge 931, the top edge 934 of the balloon piece 930 and along a portion of side edge 936. For example, second color 946 can be red as indicated by the vertical lines of border 945. Under one embodiment, the red color indicates that the bar codes on the marketing signs below second separator sheet 960 need to be scanned to determine where each marketing sign should be set in the store.

Although FIGS. 9 and 10 illustrate only first and second types of separator sheets 860 and 960 for use in the second group 104 of marketing signs for collation 100, it should be realized that additional separator sheets can be used for instructing the setting of specific marketing signs in the second group in a certain way. For example, printed indicia can include instructions indicating that marketing signs should be set in a particular area of the store other than in planogram order.

Figure 11:
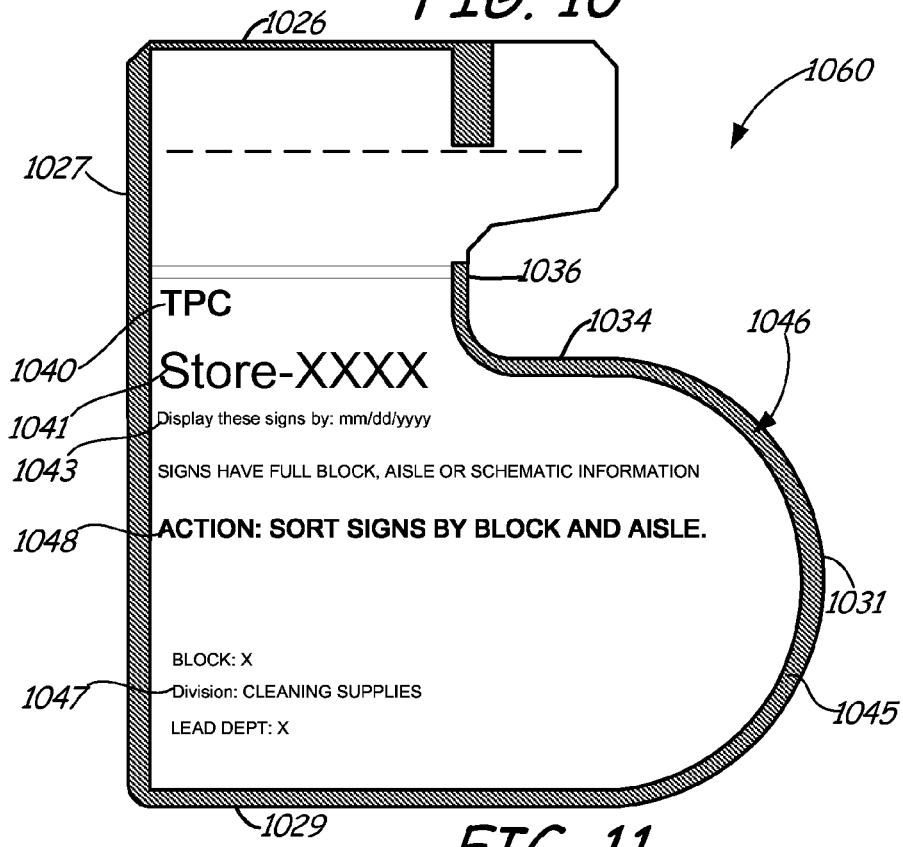
FIG. 11 illustrates a front view of an exemplary first separator sheet for placing within the third group of marketing signs under one embodiment.

FIG. 11 illustrates a front view of a first type of separator sheet or first type of block header sheet 860 for placing in the third group 106 (FIG. 1) of marketing signs under one embodiment. Like first type of separator sheets 660 and 860, first type of separator sheet 1060 is formed with the same pliable yet resilient sheet material and formed into the same non-rectangular shape as marketing signs above and below the first separator sheet 1060.

First type of separator sheet 1060 includes all of the same features as first type of separator sheets 660 and 860 including printed indicia 1040 related to the type of marketing signs that are in the third group 106 of marketing signs to which the first type of separator sheet 1060 belongs. For example, all signs in the third group to which the exemplary first type of separator sheet 1060 belongs are TPC sign. Therefore, marketing signs above and below first type of separator sheet 1060 are to highlight products that have a temporary price cut. Printed indicia 1041 having a numerical store identifier indicative of the particular retail store the collation 100 (FIG. 1) of printed marketing signs belongs, printed indicia 1043 including a date the marketing signs in the third group 106 needs to be set by for display, printed indicia 1048 including an action or instructions indicating what area of the store (identified in printed indicia 1041 as a store number and to which the marketing signs belong) the marketing signs located below first type of separator sheet 1060 should be set and printed indicia 1047 describing the area in the planogram layout where the marketing signs below the first type of separator sheet 1060 belong. For example, a team member can take the marketing signs below exemplary first type of separator sheet 1060 and go to the Cleaning Supplies area. Each sign below first type of separator sheet 1060 is ordered in accordance with the block information and in accordance with descending aisle number.

Like first type of separator sheets 660 and 860, first type of separator sheet 1060 also includes a border 1045 having a first color 1046. The color 1046 indicates how to set the sign below first type of separator sheet 1060. Border 1045 runs along a portion of base edge 1026, the left side edge 1027, the bottom edge 1029, the circumferential balloon edge 1031, top edge 1034 of the balloon piece 1030 and along a portion of side edge 1036. For example, first color 1046 can be green as indicated by the diagonal lines of border 1045. Under one embodiment, the green color indicates that marketing signs below first type of separator sheet 860 can be set in the store in planogram order.

Figure 12:
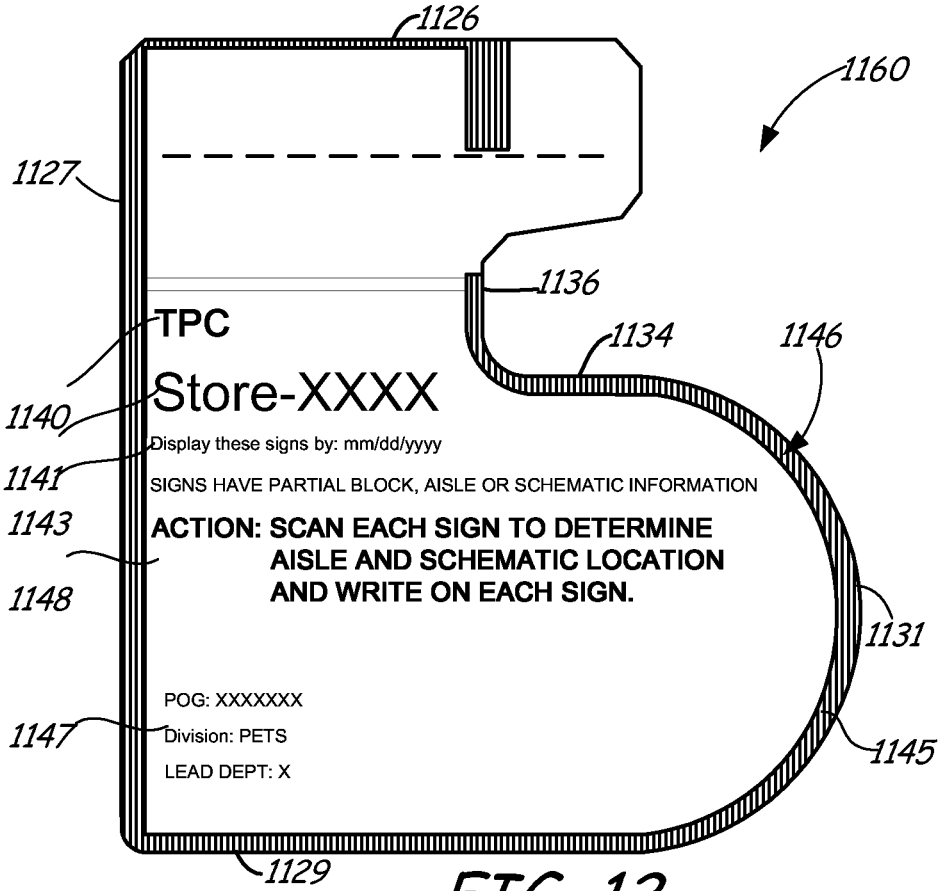
FIG. 12 illustrates a front view of an exemplary second separator sheet for placing within the third group of marketing signs under one embodiment.

FIG. 12 illustrates a front view of a second type of separator sheet or second type of block header sheet 1160 for placing in the third group 106 (FIG. 1) of marketing signs under one embodiment. Second type of separator sheet 1160 is formed with the same pliable yet resilient sheet material and formed into the same non-rectangular shape as marketing signs above and below the separator sheet 1160.

Second type of separator sheet 1160 includes all of the same features as first type of separator sheet 1060 including printed indicia 1140 related to type of marketing signs in the third group 106 of marketing signs (i.e., TPC), printed indicia 1141 including a numerical store identifier indicative of the particular retail store to which the collation 100 of marketing signs belongs, printed indicia 1143 including a date the marketing signs in the third group 106 need to be set by for display, printed indicia 1148 indicating an action to take to set the marketing signs located in the group below separator sheet 1160 and printed indicia 1147 including the last known area in the planogram layout where the marketing signs below the second type of separator sheet 1160 belong. Printed indicia 1148 includes an action or instructions different than that of first separator sheet 1060 and similar to the action or instructions included in second separator sheets 760 and 960 of first group 102 and second group 104. Specifically, printed indicia 1148 instructs that the bar code in each marketing sign below the second separator sheet 1160 needs to be scanned to determine where the current location of the product the marketing sign advertises is in the store because printed indicia 1147 may not indicate the correct information.

Like second type of separator sheets 760 and 960, second type of separator sheet 1160 also includes a border 1145 having a second color 1146. The color 1146 indicates how to set the signs located in the group below second type of separator sheet 1160. Border 1145 runs along a portion of base edge 1126, the left side edge 1127, the bottom edge 1129, the circumferential balloon edge 1131, top edge 1134 of the balloon piece 1130 and along a portion of side edge 1136. For example, second color 1146 can be red as indicated by the vertical lines of border 1145. Under one embodiment, the red color indicates that the bar codes on the marketing signs below second type of separator sheet 1160 each need to be scanned to determine where each marketing sign should be set in the store.

Although FIGS. 11 and 12 illustrate only first and second separator sheets 1060 and 1160 for use in the third group 106 of marketing signs for collation 100, it should be realized that additional separator sheets can be used for instructing the setting of specific marketing signs in the second group in a certain way. For example, printed indicia can include instructions indicating that marketing signs should be set in a particular area of the store other than in planogram order.

Figure 13:
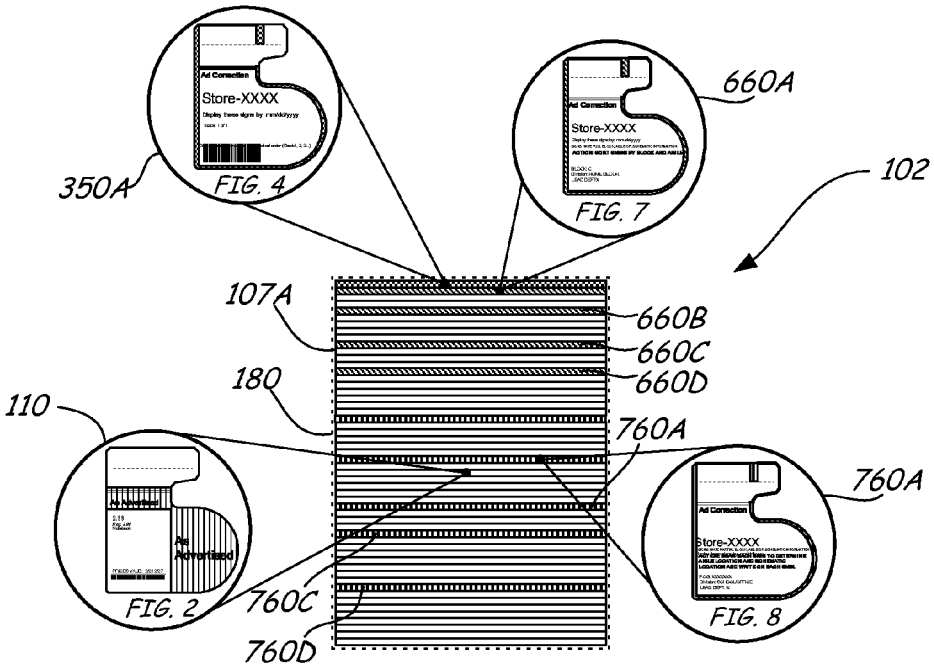
FIG. 13 illustrates a diagrammatic side view of the first group of marketing signs as illustrated in FIG. 1.

FIG. 13 illustrates a detailed diagrammatic side view of the first group 102 of marketing signs illustrated in FIG. 1. First group 102 includes an exemplary single stack 107A of sheet material including a plurality of marketing signs 110 of which the marketing signs in stack 107A are denoted by unfilled thicknesses and a front view of one exemplary marketing sign 110 is highlighted for illustrative purposes. As illustrated in dashed lines and previously discussed above, stack 107A is held together in a transparent shrink wrap 180 before being placed in a box for shipping, such as box 155 of FIG. 1.

Stack 107A of first group 102 includes a stack header sheet 350A (exemplified in more detail as sheet 350 in FIG. 4) placed on top of the stack and having an orange-colored border. First group 102 includes the necessary marketing signs needed for ad corrections, such that printed indicia on stack header sheet 350A and the orange-colored border are indicative of this type of marketing sign. As illustrated in FIG. 13, a front view of stack header sheet 350A is detailed and the side view of the stack header sheet 350A in stack 107A is denoted with a cross-hatch fill. Since exemplary first group 102 includes only a single stack 107A, stack header sheet 350A describes stack 107A as being Stack: 1 of 1.

Immediately below stack header sheet 350A, stack 107A includes a first type of separator sheet 660A (exemplified in more detail as sheet 660 in FIG. 7) having a green-colored border. First type of separator sheet 660A indicates that each marketing sign below first type of separator sheet 660A and above the next separator sheet in the group should be set in the store in the order it is stacked and in accordance with indicia printed on first separator sheet 660A indicating a planogram location. As illustrated in FIG. 13, a front view of first type of separator sheet 660A is detailed and the side view of the first type of separator sheet 660A in stack 107A is denoted with a diagonally-lined fill. Below first type of separator sheet 660A, stack 107A includes additional first type of separator sheets 660B, 660C and 660D denoted in the side view with the same diagonally-lined fill. Each of these first types of separator sheets 660B, 660C and 660D are like first type of separator sheet 660A except each includes different planogram locations in the store that need ad corrections to marketing signs. Therefore, each first type of separator sheet 660A, 660B, 660C and 660D flags marketing signs that should be set for display in a planogram order in accordance with the location information printed on the respective first type of separator sheets 660A, 660B, 660C and 660D.

First group 102 also includes a second type of separator sheet 760A (exemplified in more detail as sheet 760 in FIG. 8) having a red-colored border. Second type of separator sheet 760A indicates that the bar code on each marketing sign below second type of separator sheet 760A and above the next separator sheet should be scanned to determine where the current location in the store the marketing sign should be set for display. Even though second type of separator sheet 760A might include information indicating a planogram location, the red color of second type of separator sheet 760A indicates this information may not be the correct or current information.

As illustrated in FIG. 13, a front view of second type of separator sheet 760A is detailed and the side view of the second type of separator sheet 760A is denoted with a vertically-lined fill. Below separator sheet 760A, stack 107A includes additional second type of separator sheets 760B, 760C and 760D denoted in the side view with the same vertically-lined fill. Each of these second type of separator sheets 760B, 760C and 760D are like second type of separator sheet 760A except each includes different planogram locations in the store that need ad corrections to marketing signs and may or may not included the correct planogram information. Therefore, each second type of separator sheet 760A, 760B, 760C and 760D flags marketing signs that should be scanned in order to determine where in the store the marketing sign should be set for display.

Figure 14:
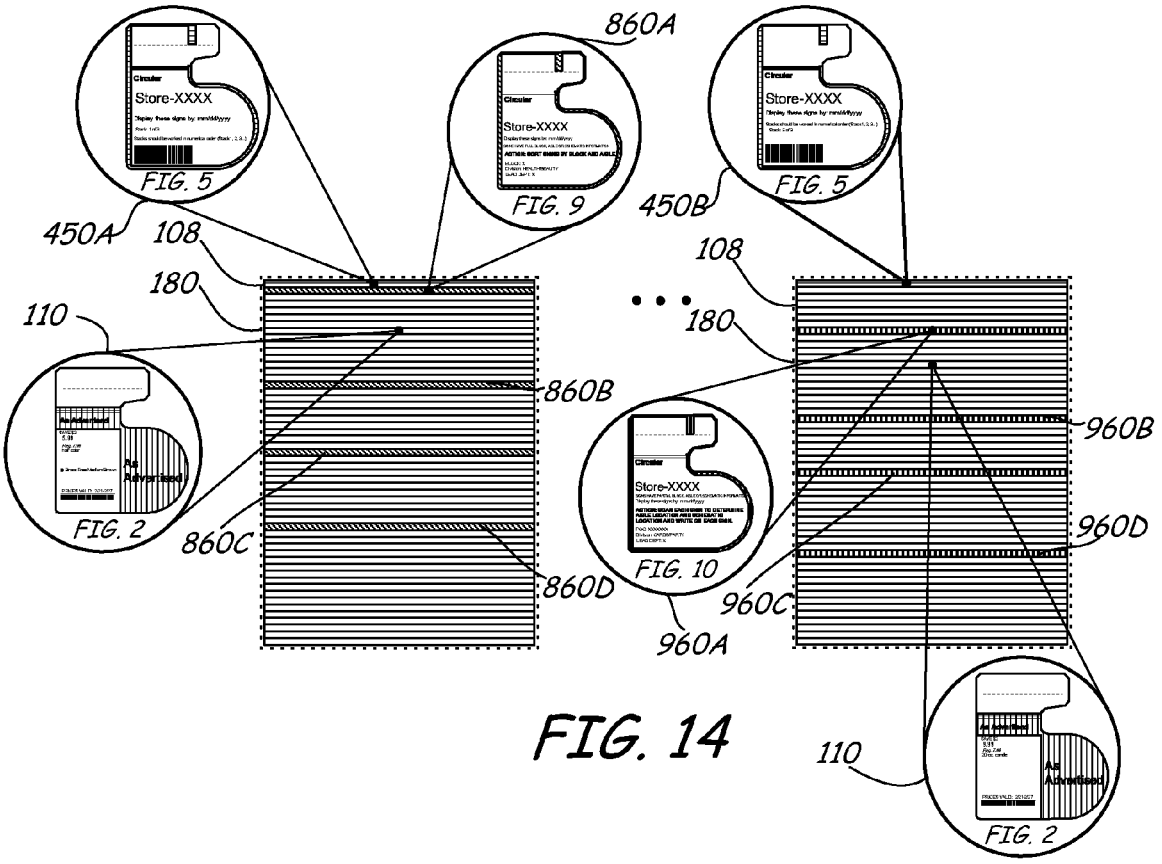
FIG. 14 illustrates a diagrammatic side view of the second group of marketing signs as illustrated in FIG. 1.

FIG. 14 illustrates a detailed diagrammatic side view of a portion of the second group 104 of marketing signs illustrated in FIG. 1. Second group 104 is an example embodiment of a grouping that has a great enough number of marketing signs that the grouping needs to be divided into multiple stacks since each stack is limited to a maximum number of printed sheet material pieces. For example, each stack can have, at most, 153 sheets per stack.

Second group 104, illustrated in FIG. 14, includes two of the three stacks of sheet material including a plurality of marketing signs 110 of which each marketing sign in group 104 in the side view are denoted by unfilled thicknesses and of which the front view of two exemplary marketing signs 110 are detailed for illustrative purposes. In particular, FIG. 14 illustrates the first stack 108A of marketing signs and the third stack 108C of marketing signs. As illustrated in dashed lines, first stack 108A and third stack 108C are held in a transparent shrink wrap 180 before being placed in a box for shipping, such as box 155 of FIG. 1.

Each stack of second group 104 includes a stack header sheet, such as stack header sheets 450A and 450C (exemplified in more detail in FIG. 5), that are placed on top of each stack and have a blue-colored border. The second group 104 includes marketing signs for products advertised in a circular. As such, the printed indicia and the border color on stack header sheets 450A and 450C indicate that this type of marketing sign is in the stacks topped by stack header sheets 450A and 450C. As illustrated in FIG. 14, a front view of exemplary stack header sheets 450A and 450C are detailed and the side view of the stack header sheet 450A in stack 108A and stack header sheet 450C in stack 108C are denoted with a horizontally-lined fill. Since second group 104 in FIG. 1 includes three stacks of marketing signs, stack header sheet 450A describes the first stack 108A as being Stack: 1 of 3 and stack header sheet 450C describes the third stack 108C as being Stack 3 of 3.

Immediately below stack header sheet 450A in first stack 108A is a first type of separator sheet 860A (exemplified in more detail in FIG. 9) having a green-colored border. First type of separator sheet 860A indicates that each marketing sign below first type of separator sheet 860A and above the next separator sheet in the group should be set in the store in the order it is stacked and in accordance with indicia printed on first type of separator sheet 860A indicating a planogram location. As illustrated in FIG. 14, a front view of exemplary first separator sheet 860A is detailed and the side view of first type of separator sheet 860A in stack 108A is denoted with a diagonally-lined fill. Below separator sheet 860A are additional green first type of separator sheets 860B, 860C and 860D also denoted in the side view by their diagonally-lined fill. Each of these first types of separator sheets 860B, 860C and 860D are like first type of separator sheet 860A except each includes different planogram locations in the store that need marketing signs for products advertised in a circular. Therefore, each first type of separator sheet 860A, 860B, 860C and 860D flags marketing signs that should be set for display in a planogram order in accordance with the location information printed on the first type of separator sheet.

Second group 104 also includes a second type of separator sheet 960A (exemplified in more detail in FIG. 10) having a red-colored border. Second type of separator sheet 960A indicates that the bar code on each marketing sign below second type of separator sheet 960A and above the next separator sheet in the group should be scanned to determine the location in the store where the marketing sign should be set for display.

Even though second type of separator sheet 960A might include information indicating a planogram location, this information might not indicate the correct information.

As illustrated in FIG. 14, a front view of exemplary second type of separator sheet 960A is detailed and the side view of the second type of separator sheet 960A is denoted by a vertically-lined fill. Below separator sheet 960A, stack 108C includes additional red-bordered second type of separator sheets 960B, 960C and 960D denoted in the side view also by their vertically-lined fill. These second types of separator sheets 960B, 960C and 960D are like second type of separator sheet 960A except each includes different planogram locations in the store that need circular-type marketing signs. Therefore, each second type of separator sheet 960A, 960B, 960C and 960D flags marketing signs that should be scanned in order to determine where in the store the marketing sign should be set for display.

It should be noted that while each stack in second group 104 includes a stack header sheet 450 labeling the stack, the location of first and second types of separator sheets 860 and 960 within the grouping depends upon the number of marketing signs under each separator sheet. While a stack header sheet 450A topping the first stack 108A in second group 104 will directly precede a separator sheet, whether that separator sheet is of a first type or second type of separator sheet is not fixed. In addition, the remainder of first and second types of separator sheets in the group 104 has no fixed location in the stacks. For example, due to the great number of circular signs in the second group 104, three stacks of marketing signs are needed. For exemplary purposes only, first type of separator sheets 860 are illustrated as being located in the first stack and second type of separator sheets 960 are illustrated as being located in the third stack. In addition, in every subsequent stack to the first stack, a separator sheet may or may not be located directly under the stack header sheet of the stack. Again, the location of separator sheets in the grouping depends on the number of marketing signs.

Figure 15:
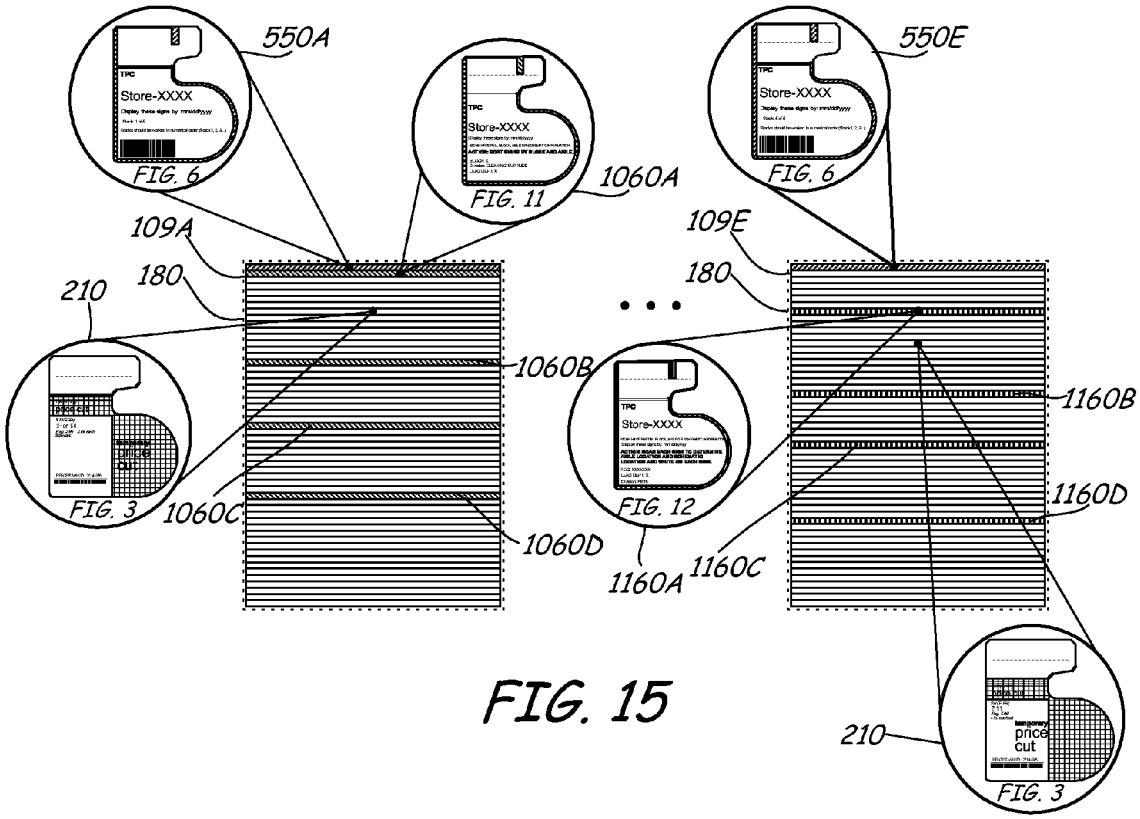
FIG. 15 illustrates a diagrammatic side view of the third group of marketing signs as illustrated in FIG. 1.

FIG. 15 illustrates a detailed diagrammatic side view of a portion of the third group 106 of marketing signs illustrated in FIG. 1. Third group 106 is an example embodiment of a grouping that has even a greater number of marketing signs than second group 104 and needs to be divided into multiple stacks since each stack is limited to a maximum number of printed sheet material pieces. For example, each stack can have, at most, 153 sheets per stack.

In FIG. 15, two of the five stacks shown in FIG. 1 are shown. The stacks include a plurality of marketing signs 210 denoted in the side view by unfilled thicknesses and of which the front view of two exemplary marketing signs 210 are detailed for illustrative purposes. In particular, FIG. 15 illustrates the first stack 109A of marketing signs and the fifth or last stack 109E of marketing signs. As illustrated in dashed lines, each stack 109A and 109E is held in a transparent shrink wrap 180 before being placed in a box for shipping, such as box 155 of FIG. 1.

Each stack of third group 106 includes a stack header sheet, such as stack header sheets 550A and 550E (exemplified in more detail in FIG. 6), that are placed on top of each stack and have a pink-colored border. The third group 106 includes marketing signs for products that have been temporarily reduced in price. As such, the printed indicia and border color on stack header sheets 550A and 550E indicate that this type of marketing sign is in the stacks topped by stack header sheets 550A and 550E. As illustrated in FIG. 15, a front view of exemplary stack header sheets 550A and 550E are detailed and the side view of the stack header sheet 550A in stack 109A and stack header sheet 550E in stack 109C are denoted with a diagonally-lined fill. Since third group 106 in FIG. 1 includes five stacks of marketing signs, stack header sheet 550A describes the first stack 109A as being Stack: 1 of 5 and stack header sheet 550E describes the fifth stack 109E as being Stack 5 of 5.

Immediately below stack header sheet 550A in stack 109A is a first type of separator sheet 1060A (exemplified in more detail in FIG. 11) having a green-colored border. First type of separator sheet 1060A indicates that each marketing sign below first type of separator sheet 1060A and above the next separator sheet in the group should be set in the store in the order it is stacked and in accordance with indicia printed on first type of separator sheet 1060A indicating a planogram location. As illustrated in FIG. 15, a front view of exemplary first type of separator sheet 1060A is detailed and the side view of first type of separator sheet 1060A in stack 109A is denoted with a diagonally-lined fill. Below separator sheet 1060A are additional first type of separator sheets 1060B, 1060C and 1060D also denoted in the side view by their diagonally-lined fill. These first types of separator sheets 1060B, 1060C and 1060D are like first type of separator sheet 1060A except each includes different planogram locations in the store that need marketing signs for products that are temporarily reduced in price. Therefore, each first type of separator sheet 1060A, 1060B, 1060C and 1060D flags marketing signs that should be set for display in a planogram order in accordance with the location information printed on the first type of separator sheet.

Third group 106 also includes a second type of separator sheet 1160A (exemplified in more detail in FIG. 12) having a red-colored border. Second type of separator sheet 1160A indicates that the bar code on each marketing sign below second type of separator sheet 1160A and above the next separator sheet in the group should be scanned to determine the location in the store where the marketing sign should be set for display. Even though second type of separator sheet 1160A might include information indicating a planogram location, this information might not indicate the correct information.

As illustrated in FIG. 15, a front view of exemplary second type of separator sheet 1160A is detailed and the side view of the second type of separator sheet 1060A is denoted with a vertically-lined fill. Below separator sheet 1160A, stack 109C includes additional red-bordered second type of separator sheets 1160B, 1160C and 1160D denoted in the side view also by their vertically-lined fill. Each of these second type of separator sheets 1160B, 1160C and 1160D are like second type of separator sheet 1160A except each includes different planogram locations in the store that need temporary price reduction signs and may or may not included the correct planogram location information. Therefore, each second type of separator sheet 1160A, 1160B, 1160C and 1160D flags marketing signs that should be scanned in order to determine where in the store the marketing signs should be set for display.

It should be noted that while each stack in third group 106 includes a stack header sheet 550 labeling the stack, the location of first and second types of separator sheets 1060 and 1160 within the grouping depend upon the number of marketing signs under each separator sheet. While a stack header sheet 1060A topping the first stack 109A in third group 106 will directly precede a separator sheet, whether that separator sheet is of a first type or a second type of separator sheet is not fixed. In addition, the remainder of first and second types of separator sheets in the group 106 has no fixed location in the stacks. For example, due to the great number of temporary price cut signs in the third group 106, five stacks of marketing signs are needed. For exemplary purposes only, first types of separator sheets 1060 are illustrated as being located in the first stack 109A and second types of separator sheets 1160 are illustrated as being located in the fifth stack 109E. In addition, in every subsequent stack to the first stack 109A, a separator sheet may or may not be located directly under the stack header sheet. Again, the location of separator sheets in the grouping depends on the number of marketing signs.

Figure 16:
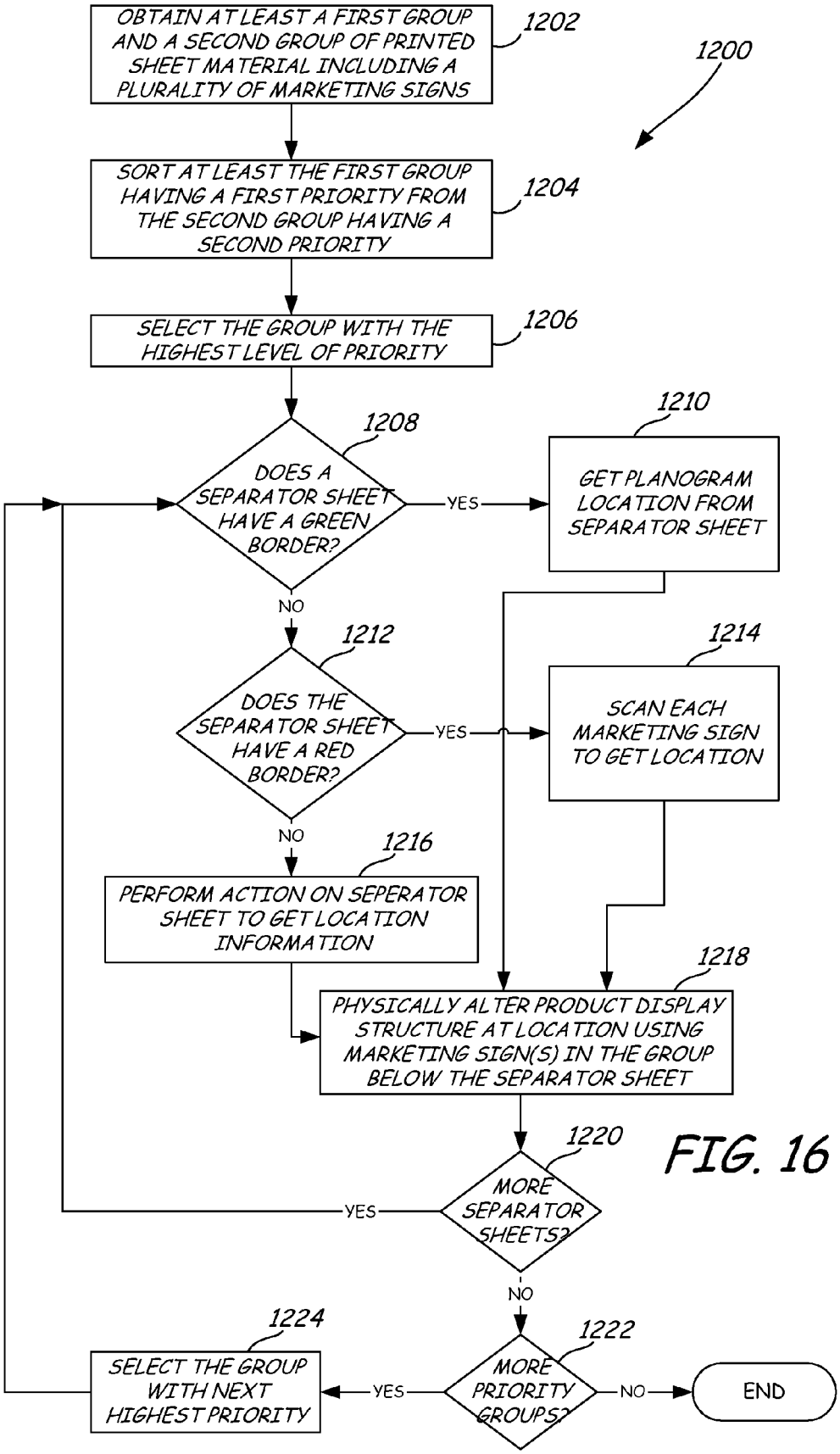
FIG. 16 is a flowchart illustrating a method of altering product display structures in a retail store

FIG. 16 is a flowchart 1200 illustrating a method of altering product display structures in a retail store. At block 1202, at least a first group and a second group of printed sheet material including a plurality of marketing signs are obtained. For example, first group 102, second group 104 and third group 106 illustrated in FIG. 1 are obtained by a team member (i.e., obtained for example in a collation of marketing signs in a shipping box 155). At block 1204, the groups having different priority levels are sorted from each other. For example, first group 102 having a first level of priority is sorted from second group 104 having a second level of priority and third group 106 having a third priority. In the example illustrated in FIG. 1, first group 102 has the highest priority and third group 106 has the lowest priority.

At block 1206, the group having the highest priority is selected and each printed sheet material should be addressed in stack order and within each stack from top to bottom. For example, first group 102 is selected. At decision block 1208, it is determined whether the separator sheet that is addressed in the first group has a green border. If yes, then planogram location information is garnered from the separator sheet at block 1210. If not, then the flowchart passes to block 1212 and it is determined whether the separator sheet has a red color border. If yes, then each marketing sign below the separator sheet and above the next separator sheet in the group is scanned to garner location information for the marketing sign. If not, then the flowchart passes to block 1216 and the team member must perform the action indicated on the separator sheet to get location information.

At block 1218, a product display structure(s) is physically altered at the location garnered in either blocks 1210, 1214 or 1216 using marketing signs in the group below the separator sheet. At block 1220, it is determined if there are any more separator sheets in the group. If yes, then the flowchart passes to back to block 1208 and goes through the method of determining the color of the separator sheet and the location of the marketing signs below it. If not, then the flowchart passes to block 1222 and it is determined whether there are any more priority groups that need to be addressed? If yes, the flowchart passes to block 1224 and the next group with the next highest priority in the collation of printed sheet material of marketing signs are selected and the flowchart passes back to block 208 and goes through the method of determining the color the separator sheet and the location of the marketing signs below it. If not, the flowchart 1200 ends.

Figure 17:
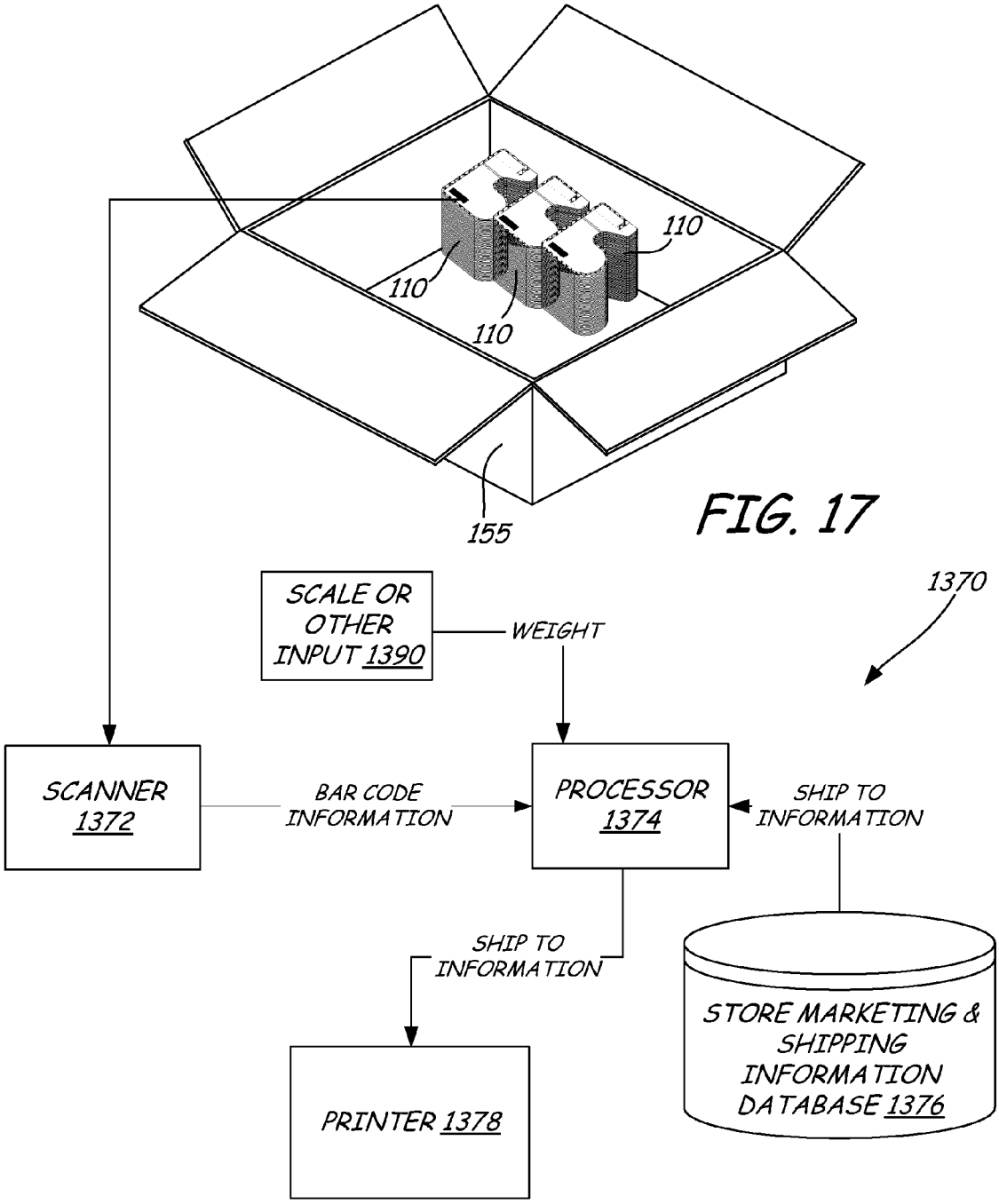
FIG. 17 illustrates a simplified block diagram of a system for shipping the collation of marketing signs illustrated in FIG. 1.
Figure 18:
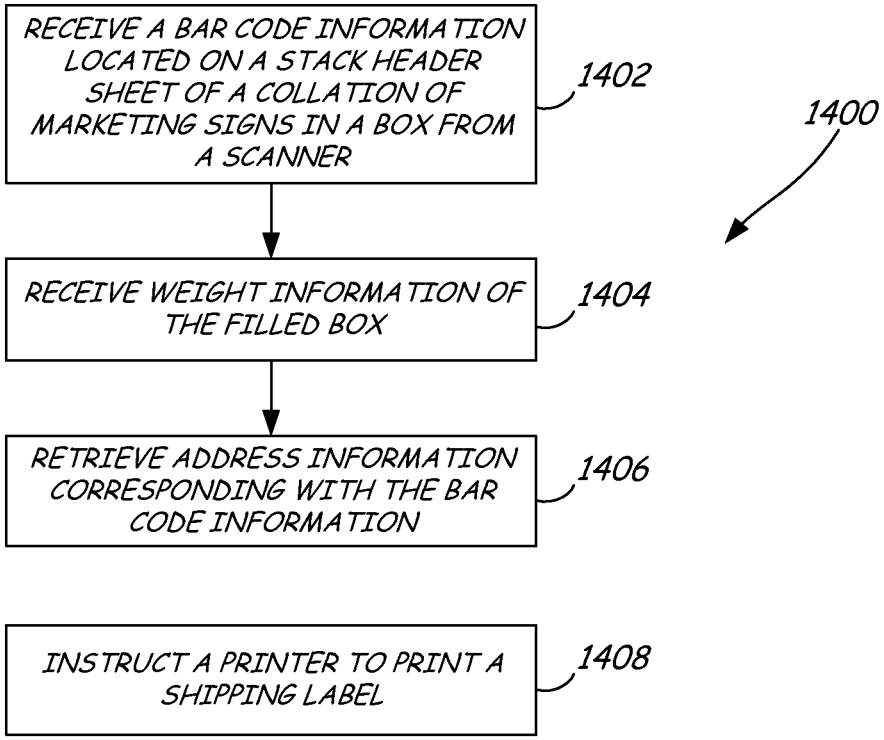
FIG. 18 is a flowchart illustrating a method performed by a processor for the shipping of marketing signs

FIG. 17 illustrates a simplified block diagram of a system 1370 for shipping a collation of marketing signs 110, such as the collation illustrated in FIG. 1. FIG. 18 illustrates a flowchart 1400 illustrating a method performed by a processor for the shipping of marketing signs. System 1370 includes an electronic scanning device or scanner 1372. After marketing signs and other sheet material, such as stack header sheets and separator sheets, are printed and collated into stacks for a particular retail store, each stack in each group for the store is wrapped in transparent shrink wrap and placed in a box 155. Before the box is sealed shut, scanner 1272 scans the bar code on one of the stack header sheets of one of the stacks regardless of the group the stack belongs. At block 1402 of FIG. 18, processor 1374 receives bar code information from scanner 1372.

Processor 1374 also receives weight information corresponding to the weight of the collation of marketing signs placed in box 155. In one embodiment, weight information can be a default value entered supplied by an input 1390. For example, the weight of the collation of marketing signs and the box will be the same for each retail store. Therefore, each filled box 155 will weigh the same amount and that weight needs only to be manually entered once and then the default value applied to each subsequent box. In another embodiment, each box filled with the collation of marketing signs is weighed by a scale 1390 and the weight is either manually or electronically received by processor 1274. At block 1404 of FIG. 18, processor 1374 receives weight information of the filled box.

After receiving the bar code identifier and weight information, processor 1374 accesses a store marketing and shipping information database 1376 using the bar code information to retrieve a shipping address of the retail store corresponding to the bar code information. At block 1406 of FIG. 18, processor 1374 retrieves address information corresponding with the bar code information. Processor 1374 instructs printer 1378 to print a shipping label including the address information accessed from shipping information database 1376 and postage based on the weight information. The printed shipping label is affixed to the box after the box is sealed shut and then the box is placed into a shipping stream. At block 1408 of FIG. 18, processor 1374 instructs printer 1378 to print a shipping label including address information and postage based on the weight information.

In general, scanner 1372 and printer 1378 are located in the area where the sheet material is printed and/or the area where the marketing signs are collated. Processor 1374 and store marketing and shipping information database 1376, however, may or may not be remotely located from the general area where the sheet material is printed and/or where the marketing signs are collated.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An article of manufacture comprising:

at least a first group of printed sheet material and a second group of printed sheet material, each group comprising:

at least one stack having a plurality of marketing signs for altering product display structures in a retail store, each marketing sign in each stack having a same non-rectangular shape;

a stack header sheet placed on top of each stack and having the same non-rectangular shape as the marketing signs in the stack and including a border having a color that indicates a priority level of the group the stack header sheet belongs with and a numerical identifier indicating the sequential order of the stack in the group;

at least one separator sheet located within the group and having the same non-rectangular shape as the marketing signs in the stack the separator sheet occupies, the separator sheet including instructions indicating how to determine a location the marketing signs positioned below the separator sheet should be set in the store; and wherein the border on the stack header sheets topping each stack in the first group of printed sheet material includes a first color that is indicative of a first level of priority and the border on the stack header sheets topping each stack in the second group of printed sheet material includes a second color different from the first color that is indicative of a second level of priority, the first level of priority indicating that product display structures are to be altered by the first group of printed sheet material in the store before product display structures are altered by the second group of printed sheet material having the second level of priority.

2. The article of manufacture of claim 1, wherein the at least one separator sheet comprises a first type of separator sheet instructing that marketing signs positioned below the first type of separator sheet and above a subsequent separator sheet in the group are located and ordered in the stack accordance with a planogram layout of the retail store.

3. The article of manufacture of claim 2, wherein the first type of separator sheet comprises a border having a first color.

4. The article of manufacture of claim 3, wherein the at least one separator sheet comprises a second type of separator sheet instructing that each bar code on each marketing sign positioned below the second type of separator sheet are be scanned to determine the location.

5. The article of manufacture of claim 4, wherein the second type of separator sheet comprises a border having a second color.

6. The article of manufacture of claim 1, wherein the marketing signs of each stack in each group are held together with transparent shrink wrap.

7. The article of manufacture of claim 6, further comprising a box for holding each shrink wrapped stack in each group for the retail store.

8. A method of altering product display structures in a retail store, the method comprising:

obtaining at least a first group of printed sheet material and a second group of printed sheet material, each group comprising:

at least one pile having a plurality of marketing signs, each marketing sign in each pile having a same non-rectangular shape;

a pile header sheet placed on top of each stack and having the same non-rectangular shape as the marketing signs in the pile, each pile header sheet indicating a priority level of the group the pile belongs with and a numerical identifier indicating a sequential number of the pile in the group;

at least one block header sheet located within the group and having the same non-rectangular shape as the marketing signs in the pile the block header sheet occupies, the block header sheet including instructions indicating how to determine a location the marketing signs positioned below the block header sheet should be set in the store; and physically altering a product display structure with one of the marketing signs in accordance with the location determined by the instructions on the block header sheet located in the pile above the marketing sign, wherein marketing signs in the first group have a first level of priority and are set before the marketing signs in the second group having a second level of priority.

9. The method of claim 8, wherein each pile header sheet topping each pile in the first group comprises a border having a first color indicating the first level of priority.

10. The method of claim 9, wherein each pile header sheet topping each pile in the second group comprises a border having a second color indicating the second level of priority.

11. The method of claim 8, wherein the at least one block header sheet comprises a first type of block header sheet instructing that marketing signs below the first type of block header sheet and above a subsequent block header sheet in the group are ordered in the stack accordance with a planogram layout of the retail store.

12. The method of claim 11, wherein the first type of block header sheet comprises a border having a first color.

13. The method of claim 12, wherein the at least one separator sheet comprises a second type of block header sheet instructing that each bar code on each marketing sign below the second type of block header sheet are to be scanned to determine location.

14. The method of claim 13, wherein the second type of block header sheet comprises a border having a second color.

* * * * *